United States Patent [19]

Petersen et al.

[11] 4,104,970

[45] Aug. 8, 1978

[54] ELECTRONIC IGNITION SYSTEM FOR LIQUID EXPLOSIVE

[75] Inventors: Gary L. Petersen; Larry L. Liedtke, both of Ridgecrest, Calif.

[73] Assignee: The United States of America as represented by the Secretary of the Navy, Washington, D.C.

[21] Appl. No.: 767,602

[22] Filed: Feb. 10, 1977

[51] Int. Cl.[2] ..... F42C 11/00

[52] U.S. Cl. ..... 102/220

[58] Field of Search ..... 102/70.2 R, 70.2 A; 42/84; 89/7, 28 R, 28 C, 135

[56] References Cited

U.S. PATENT DOCUMENTS

| | | | |
|---|---|---|---|
| 2,890,655 | 6/1959 | Apstein | 102/70.2 R |
| 2,899,864 | 8/1959 | Bloxsom, Jr. | 89/7 |
| 3,045,148 | 7/1962 | McNulty et al. | 102/70.2 R |
| 3,571,609 | 3/1971 | Knudson | 102/70.2 R |
| 3,650,174 | 3/1972 | Nelsen | 42/84 |

*Primary Examiner*—Charles T. Jordan

*Attorney, Agent, or Firm*—R. S. Sciascia; Roy Miller; Kenneth Pritchard

[57] ABSTRACT

An electronic ignition system for liquid explosive such as liquid propellant ammunition. An SCR is used to provide a long life trigger with high reliability. An inductor is used to limit peak current and lengthen the spark.

10 Claims, 5 Drawing Figures

Fig. 5
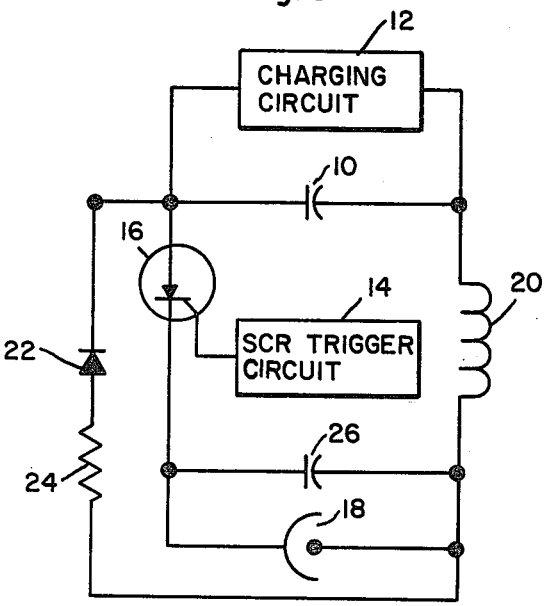
Fig. 3
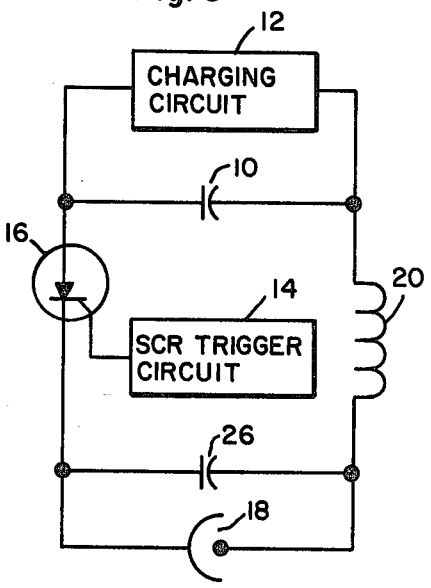
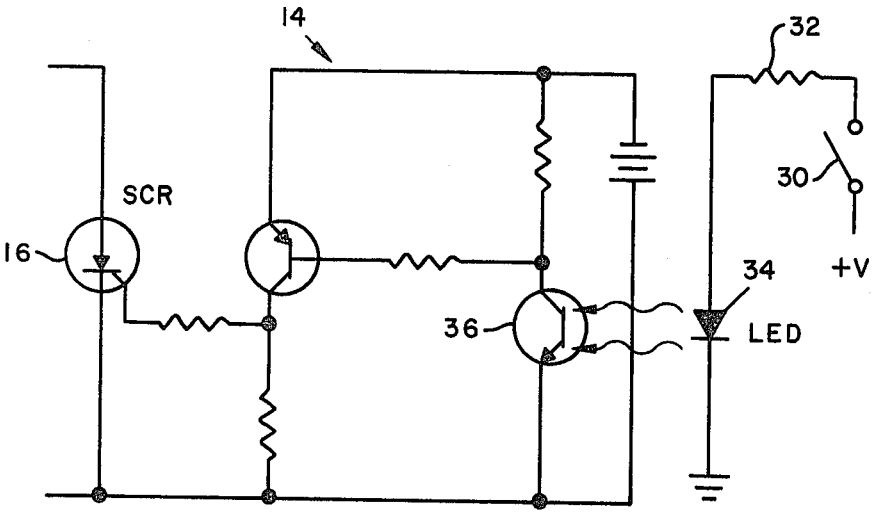
Fig. 4

ELECTRONIC IGNITION SYSTEM FOR LIQUID EXPLOSIVE

BACKGROUND OF THE INVENTION

1. Field of the Invention

This invention deals with electrical ignition systems and more particularly to an electrical ignition system for liquid explosives.

2. Description of Prior Art

In recent years liquid propellant weapons have replaced traditional weapons using solid propellant ammunition. The advantages of such weapons are given in U.S. Pat. No. 3,803,975 by Elmore and Broxholm.

Liquid propellant guns have used spark ignition systems to initiate the spark. Triggered spark gaps, thyratrons and relays have been used to perform the switching function. Triggered spark gaps require a high voltage trigger and have not been reliable. Thyratrons have worked well but after long use have conducted without application of a trigger pulse. Thyratrons are also not suitable for use in a highly dynamic environment. Relays are slow and contacts become badly pitted after just a few cycles.

SUMMARY OF THE INVENTION

The present invention provides a reliable electrical ignition system for liquid explosives. A silicon controlled rectifier, SCR, is a rugged long life device capable of surviving in a gun environment. When used as a switching gate for a high voltage capacitor the circuit is capable of delivering very low to high energy sparks, up to 400 joules.

Use of an inductor in the curcuit limits the peak current and lengthens the spark time. A diode return leg aids in recharging the capacitor.

In the SCR trigger circuit an electro-optical isolator permits high floating voltages which might occur while only requiring low voltages at the operators console where the firing button is located.

An object of the invention is to provide a long life high reliability ignition system for liquid explosives, such as a liquid propellant gun.

BRIEF DESCRIPTION OF THE DRAWINGS

FIG. 3 is a circuit drawing of a further refinement to the present invention.

FIG. 4 is an example of a possible trigger circuit for the SCR gate.

FIG. 5 is a circuit drawing of the present invention including all options.

DESCRIPTION OF THE PREFERRED EMBODIMENTS

Figure 1:
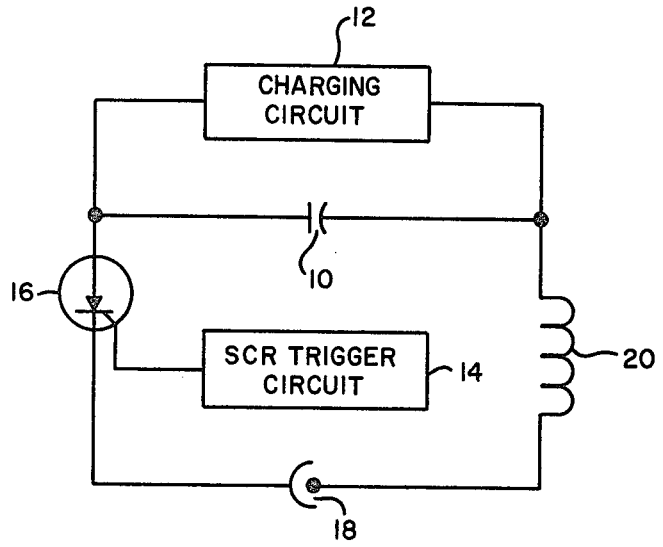
FIG. 1 is a circuit drawing of one embodiment of the present invention.

FIG. 1 shows the basic embodiment of the current invention. Capacitor 10 is charged by circuit 12. Circuit 12 can be any of the variations well known in the art. When the firing button or trigger is activated in trigger circuit 14 the SCR 16 conducts current through ignitor 18. Ignitor 18 passes a spark through the liquid propellant. The ignitor 18 can be designed in any fashion as long as some of the liquid propellant is situated between the electrodes. Inductor 20 is used to limit the peak current and lengthen the spark. One such system has been tested successfully with capacitor 10 being on the order of 50 $\mu$f and inductor 20 being a low resistance coil less than 0.3 ohms with an inductance of about 0.3 mH.

Figure 2:
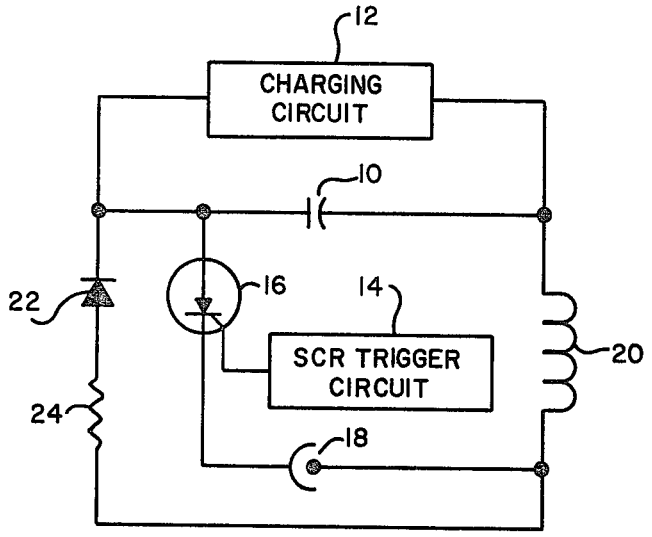
FIG. 2 is a circuit drawing of another embodiment of the present invention.

A useful variation is shown in FIG. 2 where a diode return leg has been added. The diode return leg consists of diode 22 and resistor 24. Since the SCR conducts current in only one direction, energy not dissipated in the first half cycle is retained on the capacitor as a negative charge. This charge must be removed while charging for a second firing. The diode return leg allows the circuit to oscillate through its second half cycle, returning most of the charge to proper polarity for recharging.

Resistor 24 should be selected so as to slow the reapplication of forward voltage on SCR 16 below its rated ability to handle changing voltage (i.e. dv/dt). Without resistor 24 SCR 16 may fire resulting in another spark, which in some cases may be desirable.

A further modification is shown in FIG. 3. Capacitor 26 is placed across the ignitor 18. The effect is to delay ignitor 18 from sparking until a predetermined charge has built up on cacpacitor 26. When the ignitor 18 sparks, it is essentially a short and the capacitor 26 discharges through it increasing the peak current available to ignite the liquid explosive present.

FIG. 5 shows an alternate embodiment of the present invention. This includes a diode return leg with resistor 24 and diode 22. It also includes capacitor 26 which is connected in parallel to igniter 18. All the elements shown in FIG. 5 function as described in previous Figures.

Finally in FIG. 4 an example of an SCR trigger circuit is shown. Switch 30 can be either a trigger or fire control button. When closed a current flows through resistance 32 to light emitting diode (LED) 34. Light emitted impinges on phototransistor 36 which passes through multiplying circuitry of resistors, transistor, and battery shown but not labelled to SCR 16 which is then triggered as previously discussed. The advantage of LED 34 is that it can be powered by a low voltage source while the remaining circuitry of FIG. 4 can electrically float. Thus the SCR can see a high voltage while the operator has only low voltages in his area.

What is claimed is:

1. In an electrical ignition system for firing liquid explosives the improvement which comprises:

an electro-optical isolated trigger circuit;

a silicon controlled rectifier, SCR, activated by said trigger circuit:

a capacitor electrically connected to discharge through said SCR when it is activated;

a charging circuit electically connected to said capacitor for charging said capacitor;

an inductor electrically connected to said SCR for limiting the peak current when said trigger circuit is activated; and an ignitor electrically connected between said trigger circuit and said inductor.

2. An electrical ignition system for firing liquid explosives as described in claim 1 further comprising a second capacitor placed electrically parallel to said ignitor for increasing the peak current in said ignitor.

3. In an electrical ignition system for firing liquid explosives the improvement which comprises:

a silicon controlled rectifier;

a trigger circuit wired to said SCR such that said SCR permits current flow when said trigger circuit is activated;

a first capacitor electrically connected so it discharges through the silicon controlled recitifier when said trigger circuit is activated;

a charging circuit electrically connected to charge said first capacitor;

an inductor electrically connected to said SCR for lengthening the duration of electrical pulses from said SCR when said trigger circuit is activated;

an ignitor electrically connected between said trigger circuit and said inductor; and a diode return leg electrically connected between said SCR and said inductor for shortening recharge time of said system.

4. An electrical ignition system as described in claim 3 where a capacitor is electrically connected in parallel to the ignitor.

5. An electrical ignition system as described in claim 3 where the silicon controlled rectifier trigger circuit is an electro-optical isolated trigger circuit.

6. An electrical ignition system as described in claim 4 where the silicon controlled rectifier trigger circuit is an electro-optical isolated trigger circuit.

7. In an electrical ignition system for firing liquid explosives the improvement which comprises:

a silicon controlled rectifier;

an electro-optical isolated trigger circuit wired to said SCR such that said SCR permits current flow when said trigger circuit is activated;

a capacitor electrically connected to discharge through said SCR when said trigger circuit is activated;

a charging circuit electrically connected to charge said capacitor;

an inductor electrically connected to said SCR; and an ignitor electrically connected between said inductor and said SCR.

8. An electrical ignition system as described in claim 7 that has a capacitor placed electrically parallel to the ignitor.

9. In an electrical ignition system for firing liquid explosives the improvement which comprises:

a silicon controlled rectifier;

a trigger circuit wired to said SCR such that said SCR permits current flow when said trigger circuit is activated;

a capacitor electrically connected so it discharges through the silicon controlled rectifier when said trigger is activated;

a charging circuit electrically connected to charge the capacitor;

an inductor electrically connected to the silicon controlled rectifier;

an ignitor electrically connected between the trigger circuit and the inductor;

a diode return leg electrically connected in parallel with said SCR and said ignitor; and a capacitor electrically connected in parallel to said ignitor.

10. An electrical ignition system as described in claim 9 where said trigger circuit is an electro-optical isolated trigger circuit.

* * * * *